US008706000B2

(12) United States Patent
Kaneyama et al.

(10) Patent No.: US 8,706,000 B2
(45) Date of Patent: Apr. 22, 2014

(54) DEVELOPER COLLECTING DEVICE AND IMAGE FORMING APPARATUS FOR PREVENTING TONER FROM ESCAPING

(75) Inventors: Kiyotoshi Kaneyama, Kanagawa (JP); Masatoshi Yamada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 304 days.

(21) Appl. No.: 13/103,618

(22) Filed: May 9, 2011

(65) Prior Publication Data

US 2012/0114366 A1 May 10, 2012

(30) Foreign Application Priority Data

Nov. 8, 2010 (JP) ..... 2010-249971

(51) Int. Cl.
*G03G 21/20* (2006.01)
*G03G 15/16* (2006.01)

(52) U.S. Cl.
USPC ..... 399/92; 399/101

(58) Field of Classification Search
USPC ..... 399/92, 101, 102, 345, 350, 355
See application file for complete search history.

(56) References Cited

U.S. PATENT DOCUMENTS

2007/0189802 A1* 8/2007 Maeda et al. ..... 399/101

FOREIGN PATENT DOCUMENTS

JP 03174181 A * 7/1991 ..... G03G 21/00
JP 2002278312 A * 9/2002 ..... G03G 15/16
JP 2007-171822 A 7/2007
JP 2009-098209 A 5/2009

OTHER PUBLICATIONS

Machine English Translation of JP2002-278312 published on Sep. 27, 2002.*

* cited by examiner

*Primary Examiner* — Billy Lactaoen
(74) *Attorney, Agent, or Firm* — Sughrue Mion, PLLC

(57) ABSTRACT

A developer collecting device includes a housing provided with an opening opposed to a developer carrying member; a collecting member provided along an edge of the opening at a downstream end thereof in a transporting direction of the developer carrying member, the collecting member removing developer from the developer carrying member and collecting the developer into the housing when the collecting member is in contact with the developing carrying member; a suction unit that sucks air from the opening; a flow rate regulating member provided in a suction path between the suction unit and the housing, the flow rate regulating member changing a flow rate of the air; and an operation device that moves the collecting member and operates the flow rate regulating member such that the flow rate regulating member raises the flow rate before the separation of the collecting member from the developer carrying member.

3 Claims, 11 Drawing Sheets

DEVELOPER COLLECTING DEVICE AND IMAGE FORMING APPARATUS FOR PREVENTING TONER FROM ESCAPING

CROSS-REFERENCE TO RELATED APPLICATIONS

This application is based on and claims priority under 35 USC 119 from Japanese Patent Application No. 2010-249971 filed Nov. 8, 2010.

BACKGROUND

The present invention relates to a developer collecting device and an image forming apparatus.

SUMMARY

According to an aspect of the invention, there is provided a developer collecting device including a housing provided with an opening opposed to a developer carrying member to which developer adheres while the developer carrying member rotates; a collecting member provided along an edge of the opening at a downstream end of the opening in a transporting direction of the developer carrying member, the collecting member removing the developer from an outer peripheral surface of the developer carrying member and collecting the developer into the housing when the collecting member is in contact with the developing carrying member; a suction unit that sucks air from the opening and makes air flow; a flow rate regulating member provided in a suction path between the suction unit and the housing, the flow rate regulating member changing a flow rate of the air; and an operation device that moves the collecting member and operates the flow rate regulating member such that the flow rate regulating member raises the flow rate before the separation of the collecting member from the developer carrying member.

BRIEF DESCRIPTION OF THE DRAWINGS

An exemplary embodiment of the present invention will be described in detail based on the following figures, wherein.

DETAILED DESCRIPTION

A developer collecting device and an image forming apparatus according to an exemplary embodiment of the present invention will be described with reference to FIGS. 1 to 11.

Overall Structure

Figure 11:
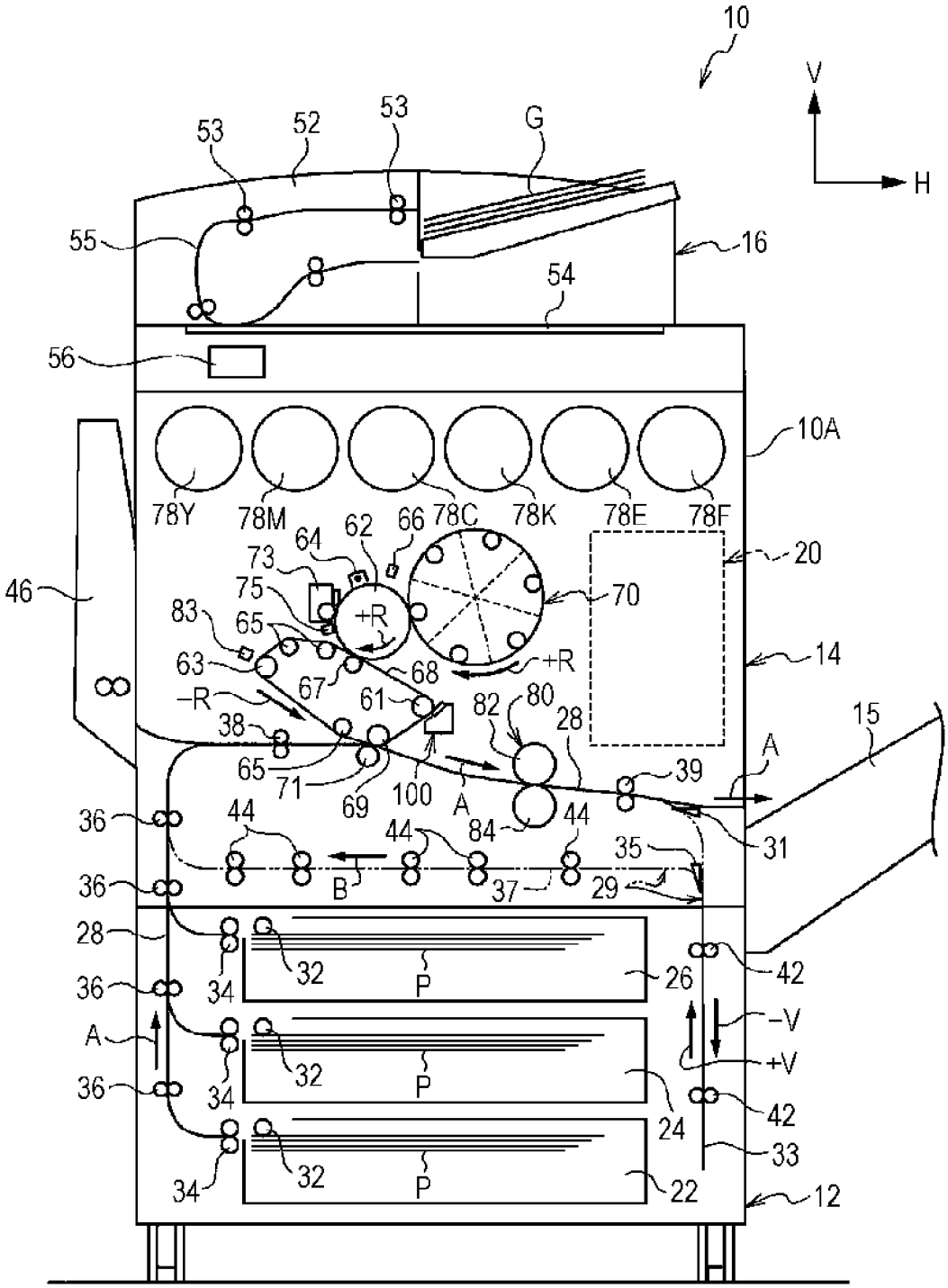
FIG. 11 is a schematic diagram illustrating the image forming apparatus according to the exemplary embodiment of the present invention.

FIG. 11 illustrates an image forming apparatus 10. The image forming apparatus 10 includes, in order from bottom to top in the vertical direction (direction of arrow V), a sheet storing unit 12 in which sheets of recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10.

In the following description, the vertical direction and the horizontal direction with respect to an apparatus body 10A of the image forming apparatus 10 will be referred to as the direction of arrow V and the direction of arrow H, respectively.

The sheet storing unit 12 includes a first storage unit 22, a second storage unit 24, and a third storage unit 26 in which sheets of recording paper P, which are examples of recording media, having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In a front view of the image forming apparatus 10, an upstream part of the transport path 28 linearly extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow V from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H. The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29. Thus, the transporting direction of each sheet of recording paper P is changed. Similarly, the second switching member 35 has the shape of a triangular prism, and a point end of the second switching member 35 is moved by a driving unit (not shown) to one of the reversing unit 33 and the transporting unit 37. Thus, the transporting direction of each sheet of recording paper P is changed. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The manual sheet-feeding unit 46 is connected to the transport path 28 at a position in front of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54. The document transport device 52 includes an automatic transport path 55 along which plural pairs of transport rollers 53 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical image carrier 62, which is an example of a latent-image carrier, arranged in a substantially central area of the apparatus body 10A. The image carrier 62 is rotated in the direction shown by arrow +R (clockwise in FIG. 11) by a driving unit (not shown), and carries an electrostatic latent image formed by irradiation with light. In addition, a corotron charging member 64 that charges the surface of the image carrier 62 is provided above the image carrier 62 so as to face the outer peripheral surface of the image carrier 62.

An exposure device 66 is provided so as to face the outer peripheral surface of the image carrier 62 at a position downstream of the charging member 64 in the rotational direction of the image carrier 62. The exposure device 66 includes a light emitting diode (LED). The outer peripheral surface of the image carrier 62 that has been charged by the charging member 64 is irradiated with light (exposed to light) by the exposure device 66 on the basis of an image signal corresponding to each color of toner. Thus, an electrostatic latent image is formed. The exposure device 66 is not limited to those including LEDs. For example, the exposure device 66 may be structured such that the outer peripheral surface of the image carrier 62 is scanned with a laser beam by using a polygon mirror.

A rotation-switching developing device 70, which is an example of a developing member, is provided downstream of a position where the image carrier 62 is irradiated with exposure light by the exposure device 66 in the rotational direction of the image carrier 62. The developing device 70 visualizes the electrostatic latent image on the outer peripheral surface of the image carrier 62 by developing the electrostatic latent image with toner of each color. The developing device 70 will be described in detail below.

An intermediate transfer belt 68, which is an example of a developer carrying member to which developer adheres, is provided downstream of the developing device 70 in the rotational direction of the image carrier 62 and below the image carrier 62. A toner image formed on the outer peripheral surface of the image carrier 62 is transferred onto the intermediate transfer belt 68. The intermediate transfer belt 68 is an endless belt, and is wound around a driving roller 61 that is rotated by the controller 20, a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction shown by arrow −R (counterclockwise in FIG. 11) when the driving roller 61 is rotated.

A first transfer roller 67 is opposed to the image carrier 62 with the intermediate transfer belt 68 interposed therebetween. The first transfer roller 67 performs a first transfer process in which the toner image formed on the outer peripheral surface of the image carrier 62 is transferred onto the intermediate transfer belt 68. The first transfer roller 67 is in contact with the back surface of the intermediate transfer belt 68 at a position downstream of the position where the image carrier 62 is in contact with the intermediate transfer belt 68 in the moving direction of the intermediate transfer belt 68. The first transfer roller 67 receives electricity from a power source (not shown), so that a potential difference is generated between the first transfer roller 67 and the image carrier 62, which is grounded. Thus, the first transfer process is carried out in which the toner image on the image carrier 62 is transferred onto the intermediate transfer belt 68.

A second transfer roller 71, which is an example of a transfer unit, is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 100, which is an example of a developer collecting device, is opposed to the driving roller 61 with the intermediate transfer belt 68 interposed therebetween. The cleaning device 100 collects residual toner that remains on the intermediate transfer belt 68 after the second transfer process. The cleaning device 100 will be described in detail below.

A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the image carrier 62. The cleaning device 73 removes residual toner and the like that remain on the surface of the image carrier 62 instead of being transferred onto the intermediate transfer belt 68 in the first transfer process. The cleaning device 73 collects the residual toner and the like with a cleaning blade and a brush roller that are in contact with the surface of the image carrier 62. An erase device 75 is provided upstream of the cleaning device 73 and downstream of the first transfer roller 67 in the rotational direction of the image carrier 62. The erase device 75 removes the electric charge by irradiating the outer peripheral surface of the image carrier 62 with light. The erase device 75 removes the electric charge by irradiating the outer peripheral surface of the image carrier 62 with light before the residual toner and the like are collected by the cleaning device 73. Accordingly, the electrostatic adhesion force is reduced and the collection rate of the residual toner and the like is increased. An additional erase device for removing the electric charge after the collection of the residual toner and the like may be provided downstream of the cleaning device 73 and upstream of the charging member 64.

The second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71. The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the horizontal direction in a replaceable manner in an area below the original-document reading device 56 and above the developing device 70. The first and second specific colors E and F may be selected from specific colors (including transparent) other than yellow, magenta, cyan, and black. Alternatively, the first and second specific colors E and F are not selected. When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K. In the present exemplary embodiment, the case in which the image forming process is performed using the four colors, which are Y, M, C, and K, and the first and second specific colors E and F are not used will be described as an example. However, as another example, the image forming process may be performed using five colors, which are Y, M, C, K, and one of the first and second specific colors E and F.

The developing device 70 will now be described.

Figure 10:
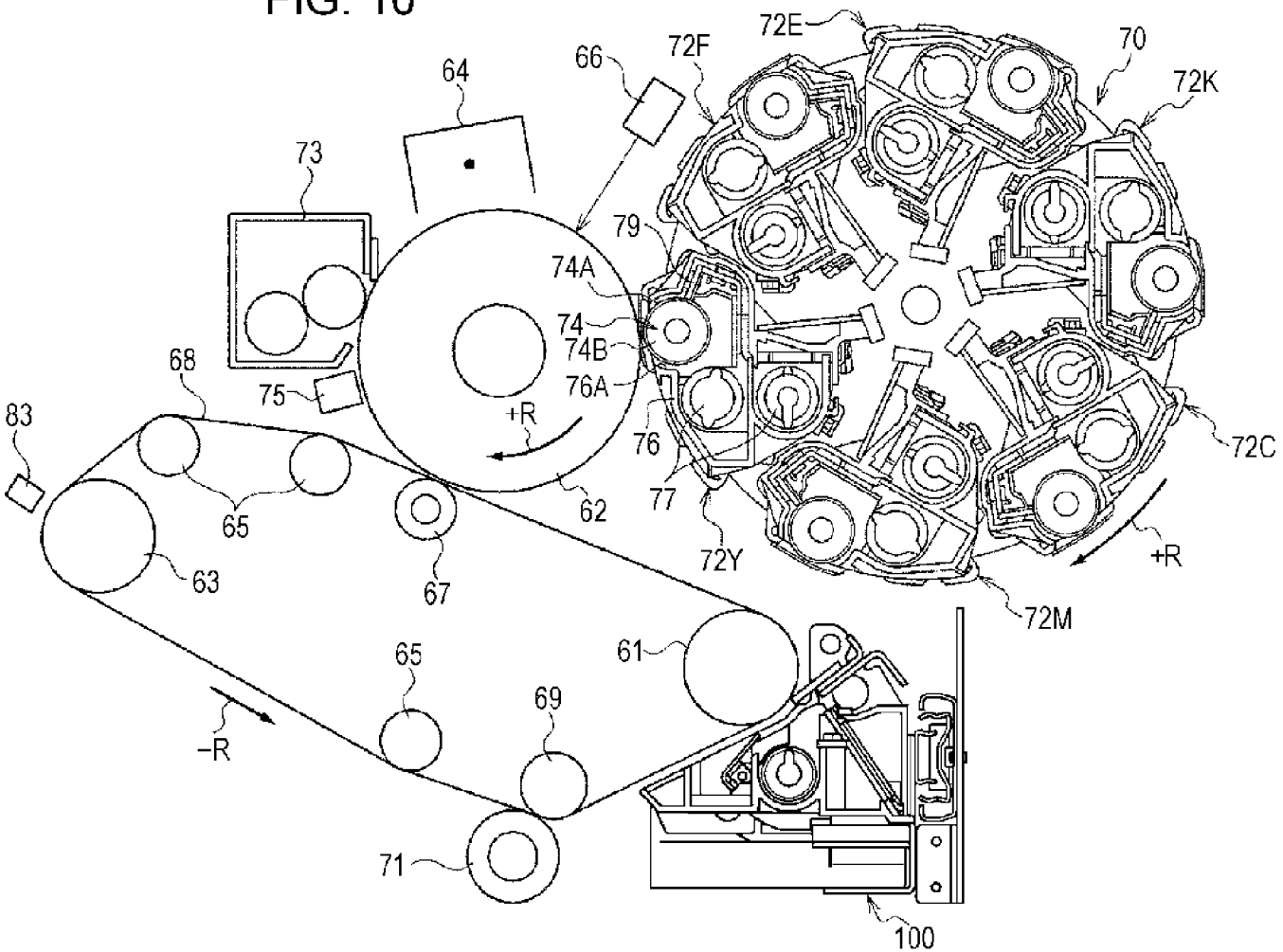
FIG. 10 is a side view illustrating a developing device and other components included in an image forming apparatus according to the exemplary embodiment of the present invention.

As illustrated in FIG. 10, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which is an example of a rotating unit, in steps of 60°. Accordingly, one of the developing units 72Y, 72M, 72C, 72K, 72E, and 72F that is to perform a developing process is selectively opposed to the outer peripheral surface of the image carrier 62.

The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 11) through a toner supply channel (not shown). The casing member 76 has a rectangular opening 76A that is opposed to the outer peripheral surface of the image carrier 62. A developing roller 74 is disposed in the opening 76A so as to face the outer peripheral surface of the image carrier 62. A plate-shaped regulating member 79, which regulates the thickness of a developer layer, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. A magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the image carrier 62. Accordingly, the toner adheres to the latent image (electrostatic latent image) formed on the outer peripheral surface of the image carrier 62. Thus, the latent image is developed.

Two helical transport rollers 77 are rotatably arranged in parallel to each other in the casing member 76. The two transport rollers 77 rotate so as to circulate the developer contained in the casing member 76 in the axial direction of the developing roller 74 (longitudinal direction of the developing unit 72Y). Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the image carrier 62.

An image forming process performed by the image forming apparatus 10 will now be described.

Referring to FIG. 11, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the image carrier 62 (see FIG. 10).

Figure 4A:
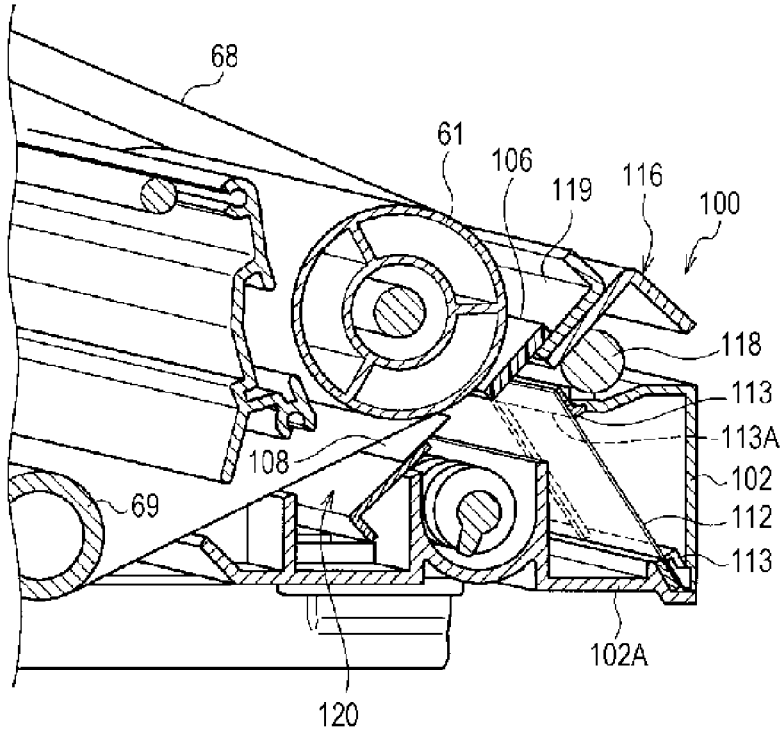
FIGS. 4A and 4B are another perspective view and another sectional view, respectively, illustrating the interior of the cleaning device according to the exemplary embodiment of the present invention.
Figure 4B:
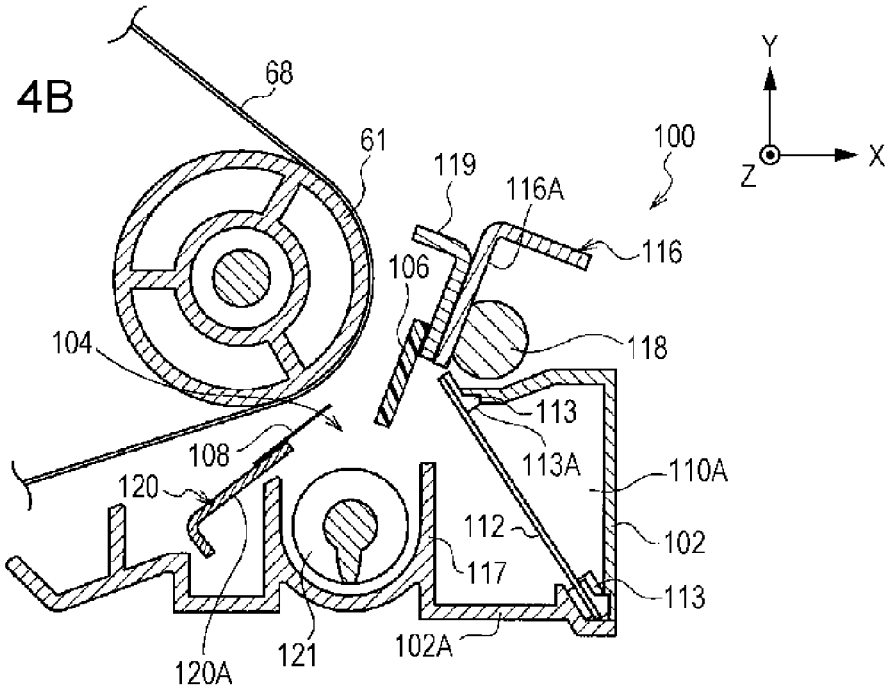
Figure 5:
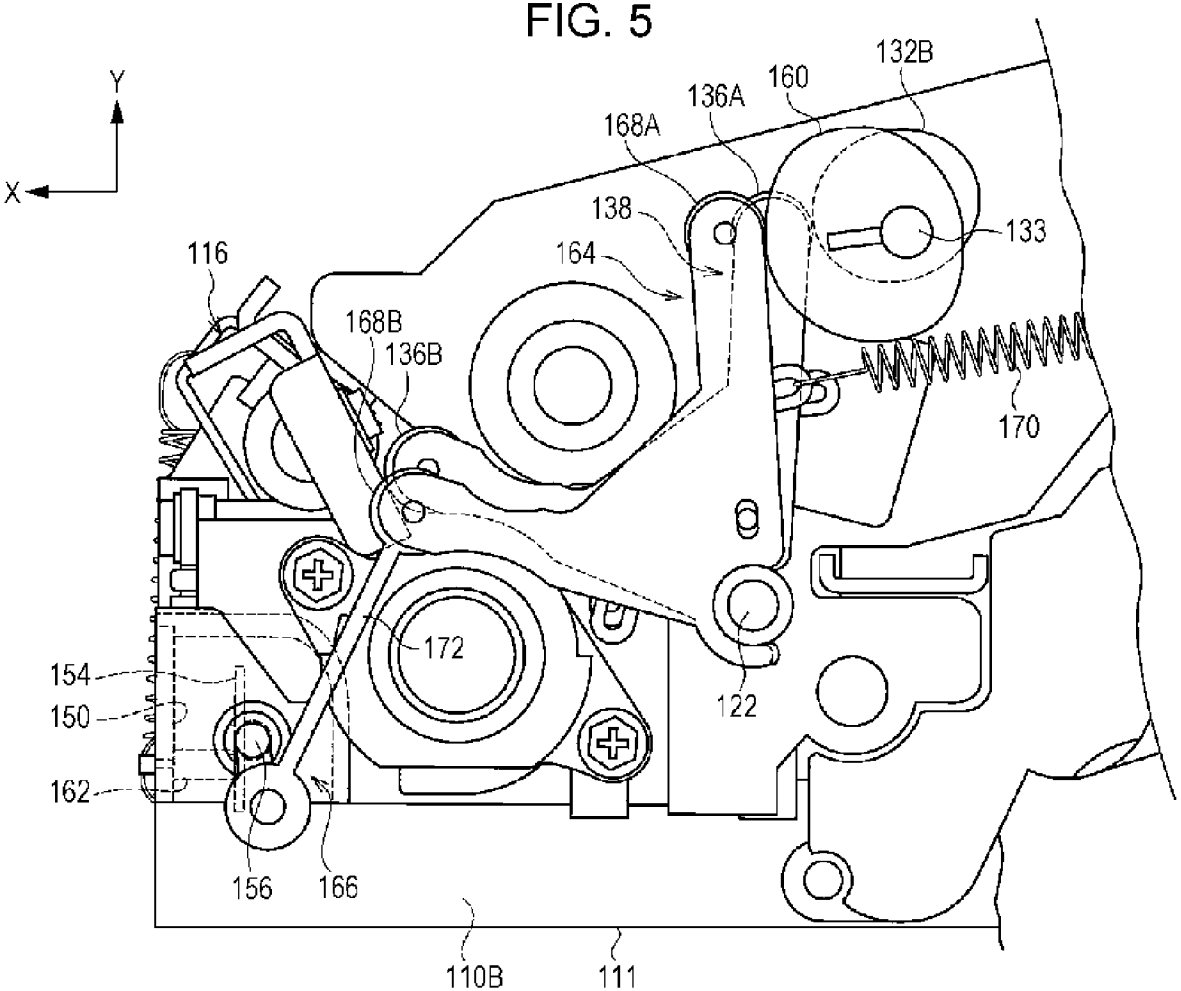
FIG. 5 is a side view illustrating the retracting mechanism included in the cleaning device according to the exemplary embodiment of the present invention.

Referring to FIG. 4B, a cleaning blade 106 and a sealing member 108 in the cleaning device 100 are separated from the outer peripheral surface of the intermediate transfer belt 68 by the operation of a retracting mechanism 130 (see FIG. 9) until the toner images of the respective colors are transferred onto the intermediate transfer belt 68 in a superimposed manner (first transfer process) and then are transferred onto the sheet of recording paper P (second transfer process). This state is referred to as a retracted state. Similarly, the second transfer roller 71 is separated from the outer peripheral surface of the intermediate transfer belt 68 in response to a movement of the auxiliary roller 69.

The exposure device 66 emits light in accordance with the image data, and the outer peripheral surface of the image carrier 62, which has been charged by the charging member 64, is exposed to the emitted light. Accordingly, an electrostatic latent image corresponding to the yellow image data is formed on the surface of the image carrier 62. The electrostatic latent image formed on the surface of the image carrier 62 is developed as a yellow toner image by the developing unit 72Y. The yellow toner image on the surface of the image carrier 62 is transferred onto the intermediate transfer belt 68 by the first transfer roller 67.

Then, referring to FIG. 11, the developing device 70 is rotated by 60° in the direction shown by arrow +R, so that the developing unit 72M is opposed to the surface of the image carrier 62. Then, the charging process, the exposure process, and the developing process are performed so that a magenta toner image is formed on the surface of the image carrier 62. The magenta toner image is transferred onto the yellow toner image on the intermediate transfer belt 68 by the first transfer roller 67. Similarly, cyan (C) and black (K) toner images are successively transferred onto the intermediate transfer belt 68, and toner images of the first specific color (E) and the second specific color (F) are additionally transferred onto the intermediate transfer belt 68 depending on the color setting.

Then, the auxiliary roller 69 moves such that the second transfer roller 71 comes into contact with the outer peripheral surface of the intermediate transfer belt 68.

A sheet of recording paper P is fed from the sheet storing unit 12 and transported along the transport path 28. Then, the sheet is transported by the positioning rollers 38 to the second transfer position in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

Figure 3A:
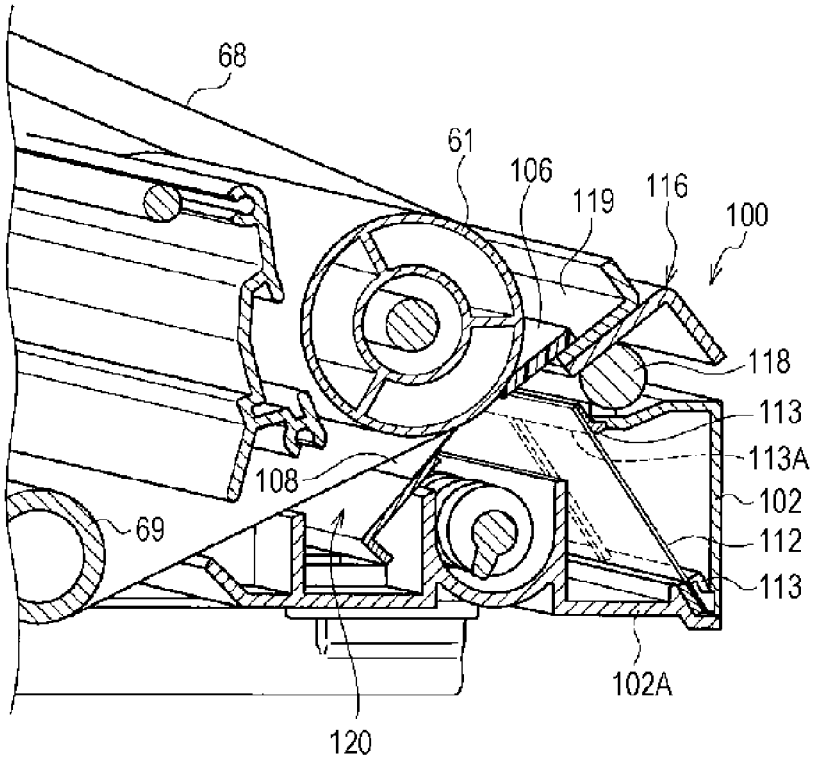
FIGS. 3A and 3B are a perspective view and a sectional view, respectively, illustrating the interior of the cleaning device according to the exemplary embodiment of the present invention.
Figure 3B:
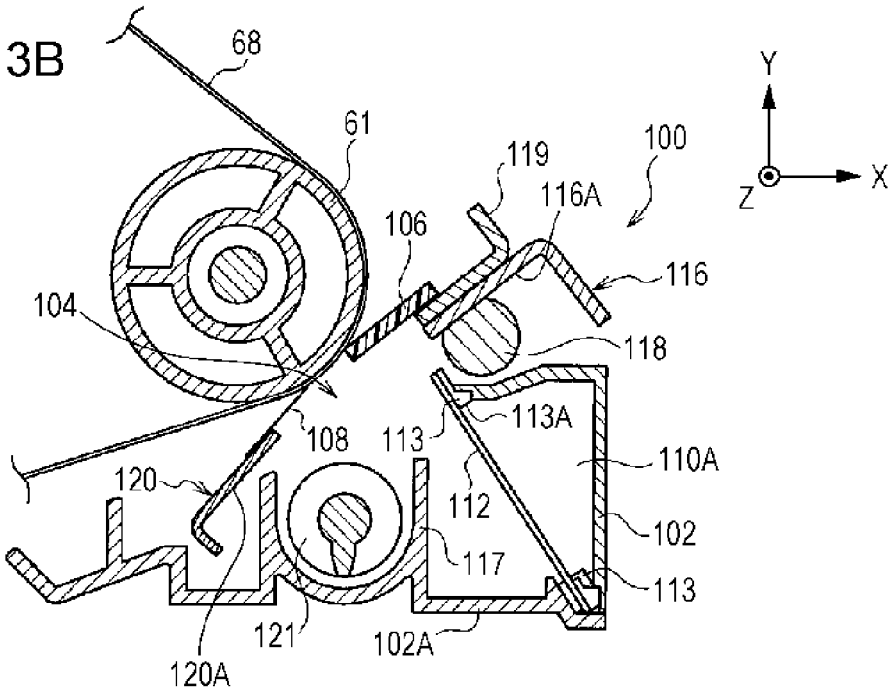
Figure 7A:
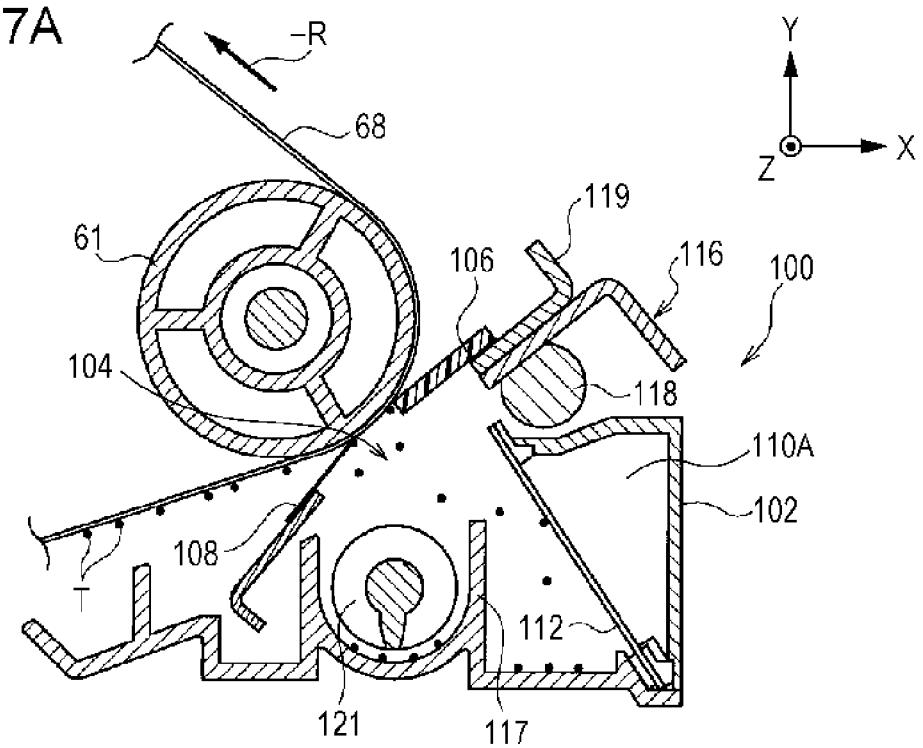
FIGS. 7A and 7B are sectional views illustrating the interior of the cleaning device according to the exemplary embodiment of the present invention.
Figure 7B:
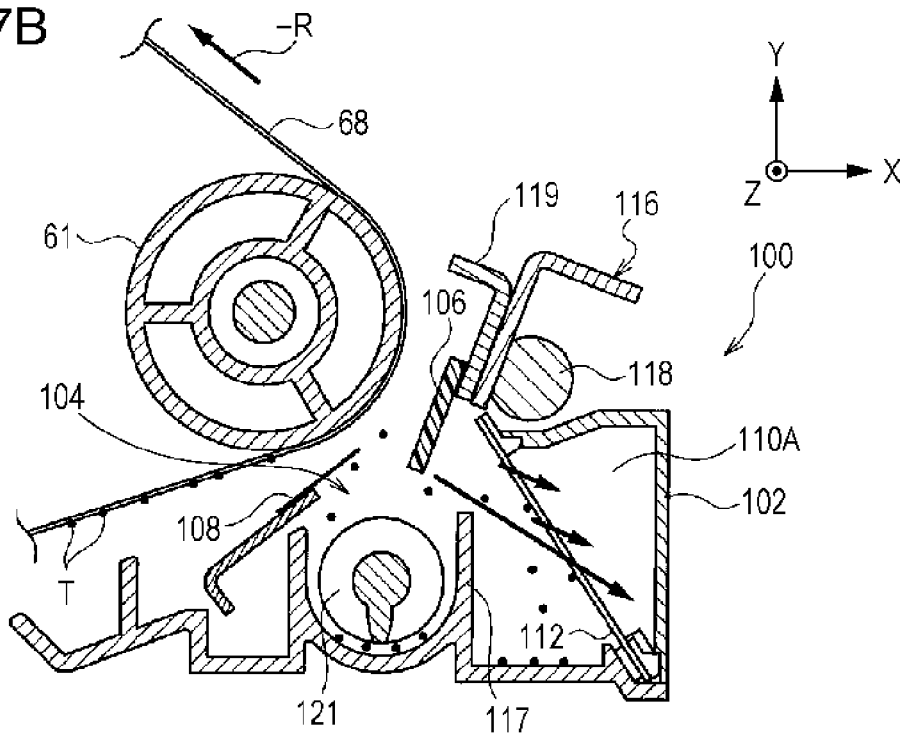

After the second transfer process, as illustrated in FIGS. 3B and 7A, the cleaning blade 106 and the sealing member 108 in the cleaning device 100 are brought into contact with the outer peripheral surface of the intermediate transfer belt 68 under the control of the controller 20. Then, the toner T on the outer peripheral surface of the intermediate transfer belt 68 is removed therefrom by the cleaning blade 106 and collected into the housing 102.

The sheet of recording paper P onto which the toner images have been transferred is transported toward the fixing device 80 in the direction shown by arrow A (rightward in FIG. 11). The fixing device 80 fixes the toner images on the sheet of recording paper P by applying heat and pressure thereto with the heating roller 82 and the pressing roller 84. The sheet of recording paper P on which the toner images are fixed are ejected to, for example, the paper output unit 15.

When images are to be formed on both sides of the sheet of recording paper P, the following process is performed. That is, after the toner images on the front surface of the sheet of recording paper P are fixed by the fixing device 80, the sheet is transported to the reversing unit 33 in the direction shown by arrow −V. Then, the sheet of recording paper P is transported in the direction shown by arrow +V, so that the leading and trailing edges of the sheet of recording paper P are reversed. Then, the sheet of recording paper P is transported along the duplex-printing transport path 29 in the direction shown by arrow B (leftward in FIG. 1), and is inserted into the transport path 28. Then, the back surface of the sheet of recording paper P is subjected to the image forming process and the fixing process.

After the fixing process, the cleaning blade 106 and the sealing member 108 are brought into contact with the outer peripheral surface of the intermediate transfer belt 68 by the operation of the retracting mechanism 130. Accordingly, the toner T on the outer peripheral surface of the intermediate transfer belt 68 is removed therefrom by the cleaning blade 106 and collected into the housing 102.

The cleaning device 100 will now be described.

Figure 9:
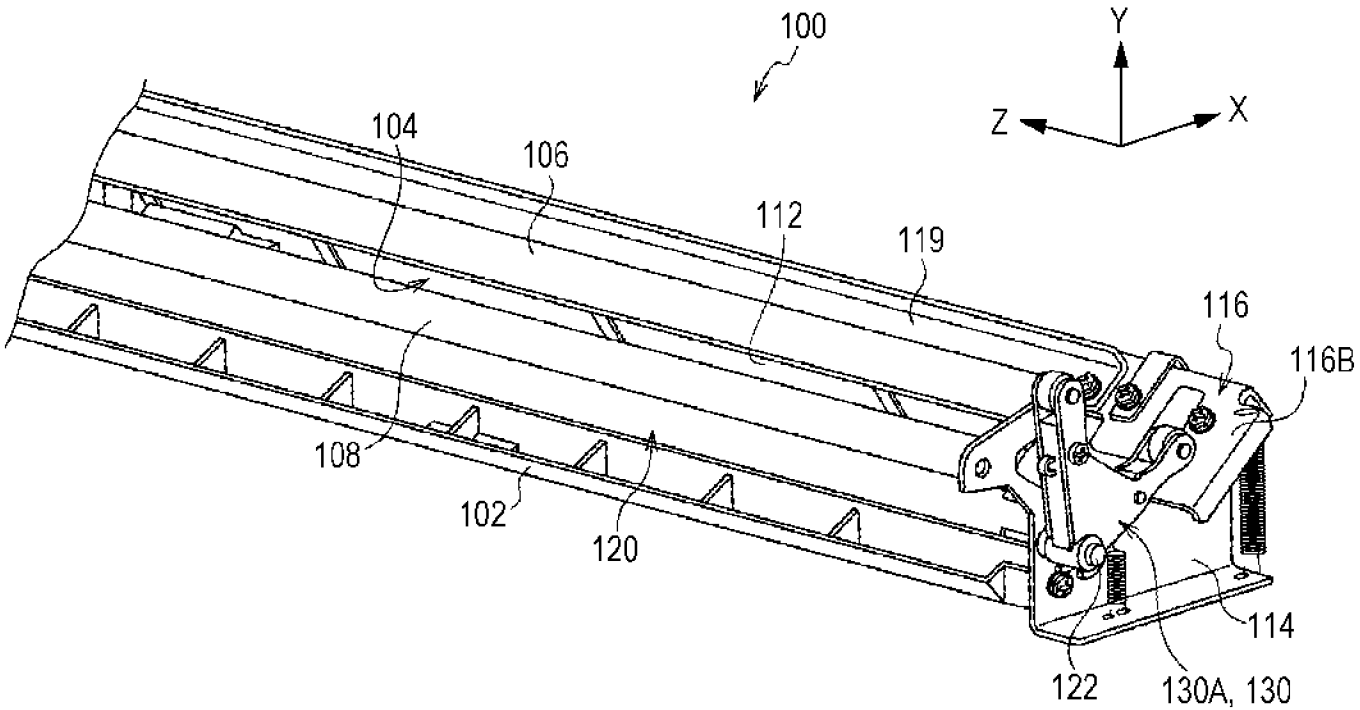
FIG. 9 is a perspective view of the cleaning device according to the exemplary embodiment of the present invention.

Referring to FIGS. 3A, 3B, and 9, the cleaning device 100 includes a housing 102, the cleaning blade 106, which is an example of a collecting member, and the sealing member 108. The housing 102 has a rectangular opening 104 that is opposed to the intermediate transfer belt 68 (see FIG. 10). The cleaning blade 106 is provided at the opening 104, and comes into contact with the intermediate transfer belt 68 to collect the toner. The sealing member 108 is provided at the opening 104 at the side opposite to the cleaning blade 106, and comes into contact with the intermediate transfer belt 68 so as to seal a gap between the housing 102 and the intermediate transfer belt 68.

The cleaning device 100 further includes a suction fan 128 (see FIG. 8), which is an example of a suction unit, a cylindrical member 111 (see FIG. 8), and a filter 112, which is an example of a capturing member. The suction fan 128 sucks in the residual toner and the like on the intermediate transfer belt 68 into the housing 102 by sucking the air from the opening 104. The cylindrical member 111 forms a suction path 110B through which the air sucked in by the suction fan 128 flows. The filter 112 is provided in the housing 102 and collects dust including the residual toner T.

In the following description of each component in the housing 102, the longitudinal direction of the housing 102 and the opening 104 is defined as a Z-direction, the direction that is orthogonal to the Z-direction and extends along the plane including a bottom wall 102A (see FIG. 3B) of the housing 102 is defined as an X-direction, and the height direction of the housing 102 that is orthogonal to the X-direction and the Z-direction is defined as a Y-direction. The Z-direction extends in the front-back direction of the image forming apparatus 10 in front view (see FIG. 1).

As illustrated in FIGS. 3A, 3B, and 9, the housing 102 is shaped such that it is open at both ends in the Z-direction and at a left end of the top plate and a top end of the left side wall when viewed in the Z-direction. Side plates 114 are attached with screws to the housing 102 at the ends thereof in the Z-direction. A first movable member 116, which is an example of a first moving member, made of a metal plate that is L-shaped in the X-Y plane is provided in the upper area of the housing 102 such that the longitudinal direction of the first movable member 116 extends in the Z-direction. FIGS. 3A and 3B illustrate the state in which the cleaning blade 106 and the sealing member 108 are in contact with the intermediate transfer belt 68. This state is referred to as a contact state.

The first movable member 116 is arranged such that it is inverted-V-shaped in the X-Y plane, and includes an inclined portion 116A (portion that extends toward the lower left in FIGS. 3A to 4B). A supporting shaft 118 is fixed to the back surface of the inclined portion 116A such that the axial direction thereof extends in the Z-direction. The supporting shaft 118 is rotatably supported by bearings (not shown) provided on the side plates 114 at the ends thereof. A supporting plate 119 made of a metal plate that is L-shaped in the X-Y plane is attached with screws to the upper surface of the inclined portion 116A of the first movable member 116. An end portion of the cleaning blade 106 in the short-side direction thereof is fixed to the bottom portion of the supporting plate 119 by adhesion. The cleaning blade 106 is arranged so as to extend along the inclination direction of the inclined portion 116A.

The cleaning blade 106 is a plate made of resin that has a rectangular shape in plan view, and is attached to the supporting plate 119 such that the longitudinal direction of the cleaning blade 106 extends along the longitudinal direction of the opening 104. Thus, the cleaning blade 106 is provided along the edge of the opening 104 at the downstream end thereof in the transporting direction of the intermediate transfer belt 68 (direction shown by arrow −R).

When the first movable member 116 is set to the contact state, the cleaning blade 106 is arranged such that a free end thereof (end that is not fixed to the supporting plate 119) is in contact with the intermediate transfer belt 68. In this state, the cleaning blade 106 collects the residual toner on the intermediate transfer belt 68 into the housing 102. A second movable member 120 made of an L-shaped metal plate is provided in the left area of the housing 102 in the X-Y plane such that the longitudinal direction of the second movable member 120 extends in the Z-direction.

The second movable member 120 is arranged such that it is bent so as to project leftward in the X-Y plane, and includes an inclined portion 120A (portion that extends downward toward the lower left in FIGS. 3A to 4B) in an upper area thereof. A rotatable supporting shaft (not shown) is attached to the back surface of the inclined portion 120A such that the axial direction thereof extends in the Z-direction. Thus, the second movable member 120 is rotatably supported. The second movable member 120 is rotated (moved) in association with the movement of the first movable member 116 by a link mechanism (not shown). An end portion of the sealing member 108 in the short-side direction thereof is fixed to the top portion of the inclined portion 120A of the second movable member 120 by adhesion.

The sealing member 108 is, for example, a transparent film having a rectangular shape in plan view, and is attached to the second movable member 120 such that the sealing member 108 comes into contact with the intermediate transfer belt 68 along the edge of the opening 104 at the upstream end thereof in the transporting direction of the intermediate transfer belt 68. When the first movable member 116 is set to the contact state and the cleaning blade 106 is in contact with the intermediate transfer belt 68, the sealing member 108 is arranged such that a free end thereof (end that is not attached to the second movable member 120) is in contact with the intermediate transfer belt 68. In this state, the sealing member 108 seals the gap between the housing 102 and the intermediate transfer belt 68. The sealing member 108 is disposed below the cleaning blade 106. The end portion of the sealing member 108 is pointed toward the downstream in the moving direction of the intermediate transfer belt 68. Therefore, the sealing member 108 does not remove the toner T from the intermediate transfer belt 68.

As illustrated in FIGS. 3A and 3B, an attachment member 113 used to attach the filter 112 to the housing 102 is provided at the right side of the housing 102 in the X-Y plane. The attachment member 113 is frame-shaped and is obtained by forming plural openings 113A of rectangular through holes in a rectangular plate along the longitudinal direction of the plate. The attachment member 113 is disposed in the housing 102 in an inclined manner such that a lower portion of the attachment member 113 is farther away from the intermediate transfer belt 68 and the opening 104 than an upper portion thereof in the X-Y plane.

The attachment member 113 sections the housing 102 such that a suction path 110A having an inverted triangular shape in the X-Y plane is provided at the right side of the housing 102. The filter 112 is attached to the housing 102 with the attachment member 113.

The filter 112 is a fiber assembly, and is formed in a rectangular shape that is long in the longitudinal direction of the housing 102 (Z-direction) in front view. The filter 112 is bonded to the attachment member 113 and is disposed between the opening 104 and the suction path 110A in the housing 102 in an inclined manner such that a lower portion of the filter 112 is farther away from the opening 104 than an upper portion thereof in side view (X-Y plane).

As illustrated in FIGS. 3A and 3B, a transporting member 121 is provided between a partition wall 117 which stands on the bottom wall 102A and the second movable member 120 in a lower area of the housing 102. The transporting member 121 has plural helical grooves in the outer peripheral surface thereof, and is rotatable around a rotational axis direction that extends in the Z-direction. The transporting member 121 is provided with a driving unit (not shown) including a motor at the back side in the Z-direction. The transporting member 121 transports the toner collected in the housing 102 to the back side in the Z-direction under the control of the controller 20 (see FIG. 11).

Referring to FIG. 9, a cylindrical collection path (not shown) is provided at the back end of the housing 102 in the Z-direction. The toner transported by the transporting member 121 is guided to a collection tank (not shown) through the collection path.

Figure 1:
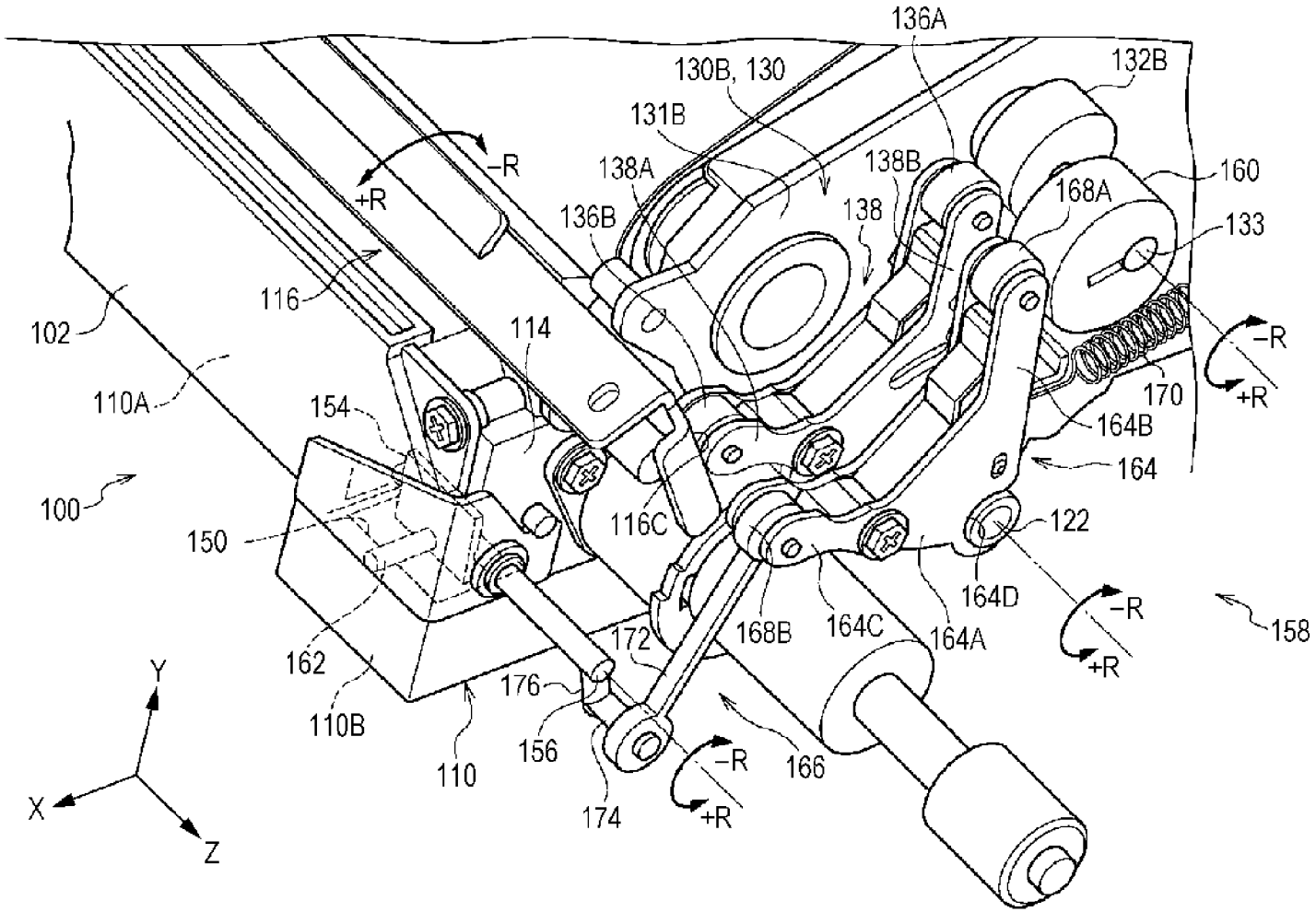
FIG. 1 is an enlarged perspective view illustrating a retracting mechanism included in a cleaning device according to an exemplary embodiment of the present invention.
Figure 2:
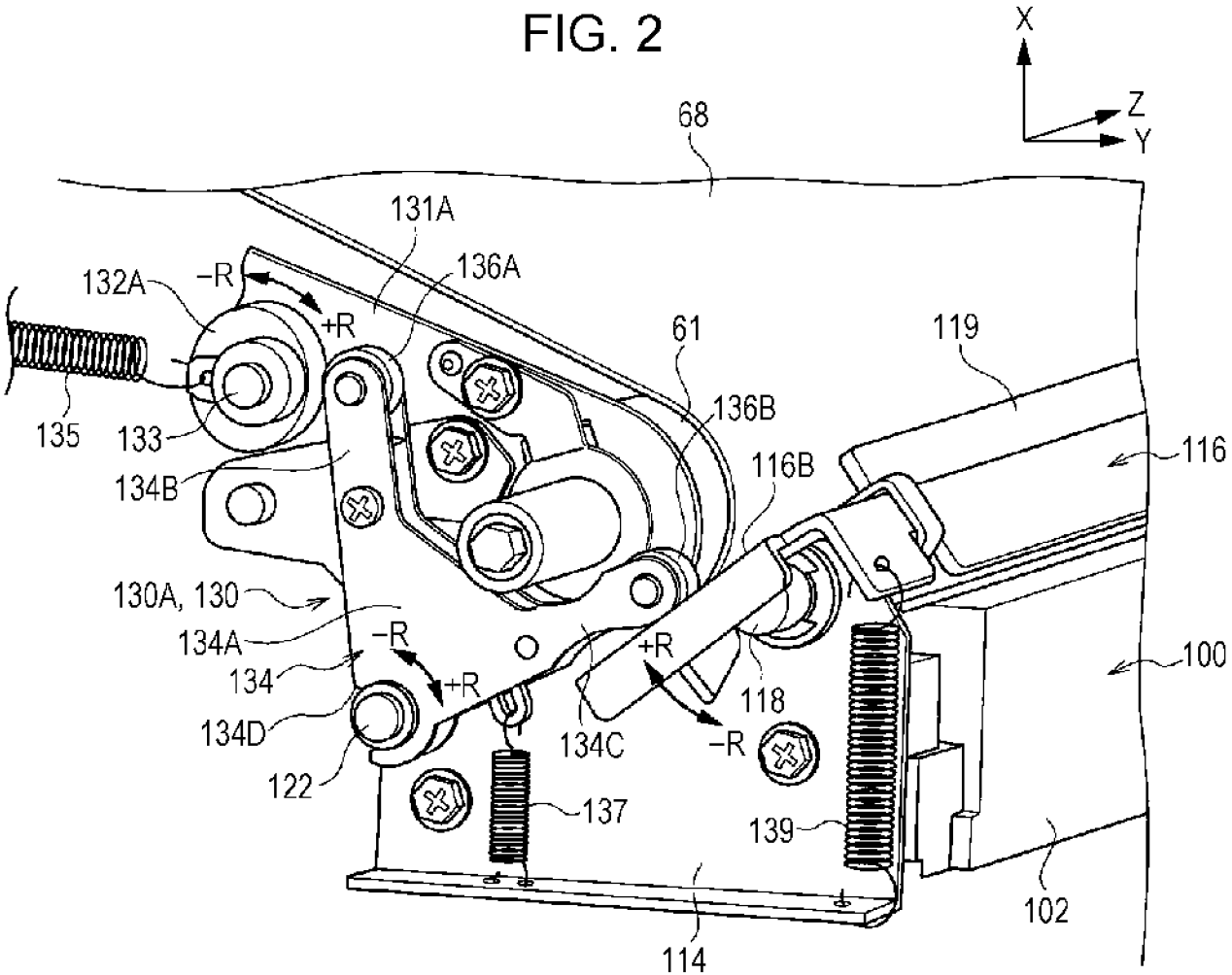
FIG. 2 is another enlarged perspective view illustrating the retracting mechanism included in a cleaning device according to the exemplary embodiment of the present invention.

Referring to FIGS. 1 and 2, the retracting mechanism 130 moves the cleaning blade 106 and the sealing member 108 between positions at which they are in contact with the outer peripheral surface of the intermediate transfer belt 68 and positions at which they are separated from the outer peripheral surface of the intermediate transfer belt 68. The retracting mechanism 130 includes a first mechanism unit 130A (see FIG. 2) provided at the front side in the Z-direction and a second mechanism unit 130B (see FIG. 1) provided at the back side in the Z-direction.

Side plates 131A and 131B are provided at the front and back sides, respectively, at positions near the ends of the intermediate transfer belt 68 in the Z-direction (width direction).

As illustrated in FIG. 2, the first mechanism unit 130A includes an eccentric cam 132A, which is an example of a first cam, and an arm member 134. The eccentric cam 132A is rotated by a drive source (not shown). The arm member 134 is provided on one of the side plates 114 of the cleaning device 100, and moves the first movable member 116 and the second movable member 120 (see FIG. 9) in response to the rotation of the eccentric cam 132A.

A shaft member 133 is rotatably provided on the side plate 131A, and the eccentric cam 132A is attached to a first end (front end in the Z-direction) of the shaft member 133. A spring 135 is attached to the side plate 131A at one end thereof, and the other end of the spring 135 is attached to an eccentric portion of the eccentric cam 132A that is offset from the shaft member 133.

The arm member 134 is substantially V-shaped in plan view, and includes two plates having the same size that are integrated with each other with a gap therebetween.

More specifically, the arm member 134 includes a base portion 134A having an inverted triangular shape, a first arm 134B that extends toward the upper left from the upper left part of the base portion 134A in front view, and a second arm 134C that extends toward the upper right from the upper right part of the base portion 134A in front view. In addition, an arc-shaped cut portion 134D to which a support shaft 122 is fixed is formed in the base portion 134A at the lower end (at the vertex) thereof.

Rollers 136A and 136B are rotatably provided at the top ends of the first arm 134B and the second arm 134C, respectively.

The arm member 134 is movable around the support shaft 122 in the +R direction (clockwise in FIG. 2) and the −R direction (counterclockwise in FIG. 2). Accordingly, the first arm 134B and the second arm 134C are movable in the +R direction and the −R direction.

A spring 137 is attached at one end thereof to the base portion 134A of the arm member 134 at the side where the second arm 134C is provided. The other end of the spring 137 is attached to a bottom portion of the side plate 114. Thus, when the eccentric cam 132A is not in contact with the arm member 134, the arm member 134 receives a rotational force in the +R direction.

A spring 139 is attached at one end thereof to an end portion of the first movable member 116, and the other end of the spring 139 is attached to the bottom portion of the side plate 114. Thus, the first movable member 116 receives a rotational force in the +R direction. The roller 136B is in contact with a contact portion 116B, which is a flat surface of the first movable member 116 provided at the front end thereof.

The roller 136A comes into contact with the eccentric cam 132A when the eccentric cam 132A rotates in the +R direction, and moves away from the eccentric cam 132A when the eccentric cam 132A rotates in the −R direction. When the eccentric cam 132A comes into contact with the roller 136A and moves the arm member 134 in the +R direction, the roller 136B pushes the contact portion 116B of the first movable member 116 and moves the first movable member 116 in the −R direction. Then, when the eccentric cam 132A moves away from the roller 136A, the first movable member 116 moves in the +R direction.

As illustrated in FIG. 1, the second mechanism unit 130B includes an eccentric cam 132B, which is an example of a first cam, and an arm member 138. The eccentric cam 132B is provided on the side plate 131B, and is rotated by a drive source (not shown). The arm member 138 is also provided on the side plate 131B, and moves the first movable member 116 and the second movable member 120 (see FIG. 9) in response to the rotation of the eccentric cam 132B. The eccentric cam 132B is attached to a second end (back end in the Z-direction) of the shaft member 133.

The arm member 138 has a structure similar to that of the arm member 134 (see FIG. 2). The arm member 138 rotates around the above-described support shaft 122, which projects from the side plate 131B at the back end thereof, in the +R direction or the −R direction. Accordingly, a first arm 138B and a second arm 138C move in the +R direction or the −R direction. Similar to the arm member 134, when the eccentric cam 132B is not in contact with the arm member 138, the arm member 138 receives a rotational force in the +R direction on the basis of an urging force of a spring (not shown). In addition, the first movable member 116 receives a rotational force in the +R direction on the basis of an urging force of a spring (not shown). The roller 136B is in contact with a contact portion 116C, which is a flat surface of the first movable member 116 provided at the back end thereof.

The roller 136A comes into contact with the eccentric cam 132B when the eccentric cam 132B rotates in the +R direction, and moves away from the eccentric cam 132B when the eccentric cam 132B rotates in the −R direction. When the eccentric cam 132B comes into contact with the roller 136A and moves the arm member 138 in the +R direction, the roller 136B pushes the contact portion 116C of the first movable member 116 and moves the first movable member 116 in the −R direction (see FIG. 4B). Then, when the eccentric cam 132B moves away from the roller 136A, the first movable member 116 moves in the +R direction (see FIG. 3B).

Thus, the state in which the cleaning blade 106 and the sealing member 108 are separated from the intermediate transfer belt 68 (retracted state) is established when the first movable member 116 is moved in the −R direction. In contrast, the state in which the cleaning blade 106 and the sealing member 108 are in contact with the intermediate transfer belt 68 (contact state) is established when the first movable member 116 is moved in the +R direction.

The suction fan 128 that sucks in the residual toner removed from the intermediate transfer belt 68 by the cleaning blade 106 into the housing 102 and a suction path 110 through which the air sucked in by the suction fan 128 flows will now be described.

Figure 8:
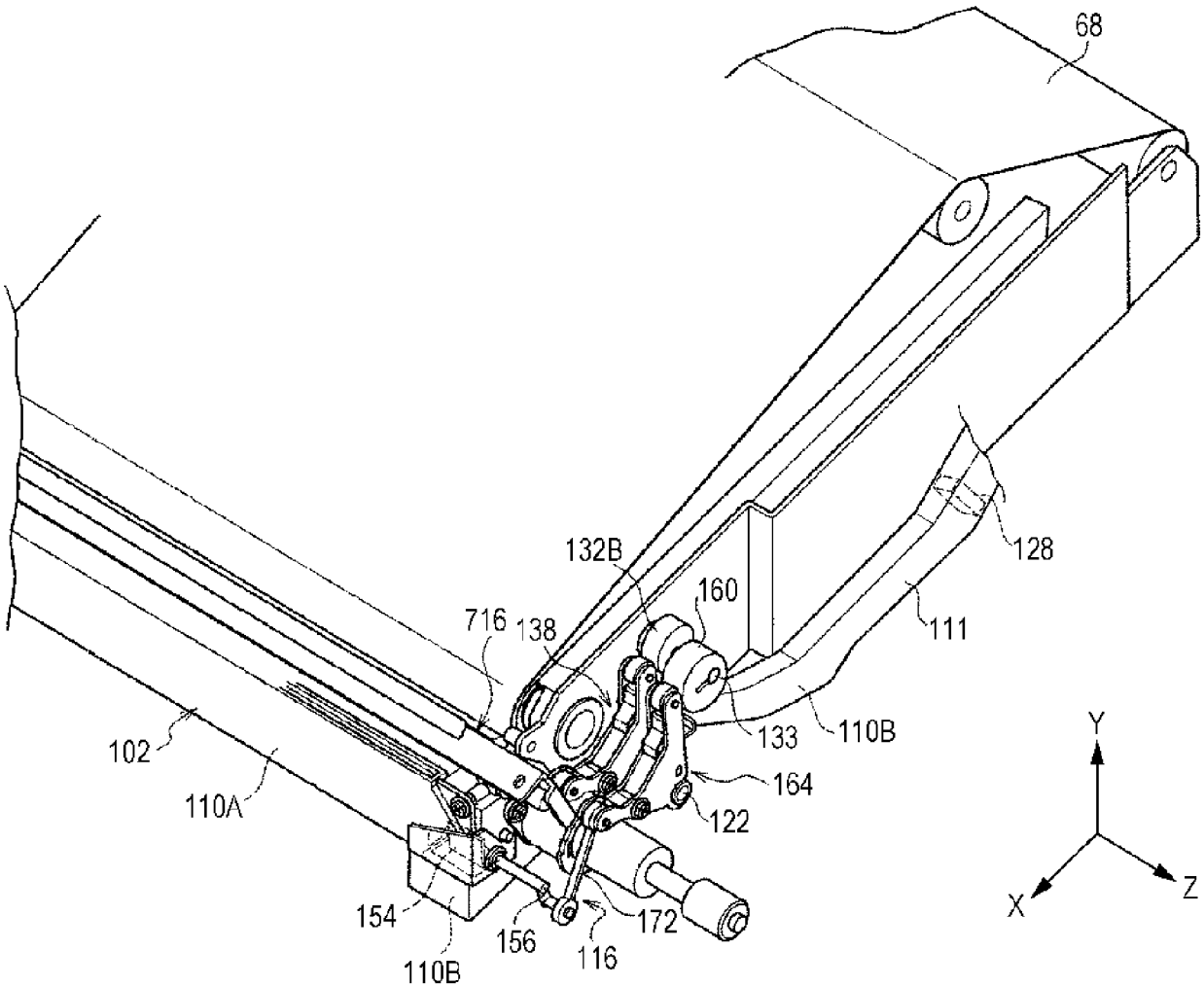
FIG. 8 is a perspective view illustrating the cleaning device and an intermediate transfer belt according to the exemplary embodiment of the present invention.

Referring to FIGS. 1, 3B, and 8, the air flows through the suction path 110 when the suction fan 128 is operated. The suction path 110 includes the suction path 110A and the suction path 110B. The suction path 110A is surrounded by the housing 102 and the filter 112 and extends in the Z-direction. The suction path 110B is connected, through a rectangular opening 150, to the suction path 110A at the back end thereof in the Z-direction and extends in the X direction at the back side of the intermediate transfer belt 68 in the Z-direction.

The opening 150 is provided with an valve 154, which is an example of a flow rate regulating member that regulates the air flow by broadening or narrowing the suction path 110 in accordance with the orientation or position thereof.

The valve 154 is a rectangular plate member, and an end portion of the valve 154 is supported by a rotational shaft 156 that is rotatable. When the rotational shaft 156 is rotated in the +R direction illustrated in FIG. 1, the valve 154 comes into contact with a stopper 162 and is stopped at a closed position at which the valve 154 closes the opening 150 (see FIG. 6). When the rotational shaft 156 is rotated in the −R direction illustrated in FIG. 1, the valve 154 comes into contact with the stopper 162 and is stopped at an open position at which the opening 150 is opened (see FIG. 5).

A third mechanism unit 158 provided to rotate the rotational shaft 156 will now be described.

As illustrated in FIG. 1, the third mechanism unit 158 includes an eccentric cam 160, which is an example of a second cam, an arm member 164, and a link member 166, which is an example of a second moving member. The eccentric cam 160 is rotated by a drive source (not shown). The arm member 164 is provided on the other one of the side plates 114 of the cleaning device 100 and is moved in response to the rotation of the eccentric cam 160. The link member 166 is pushed by the arm member 164 and rotates the rotational shaft 156.

The eccentric cam 160 is disposed next to the eccentric cam 132B and is attached to the second end (back end in the Z-direction) of the shaft member 133.

The arm member 164 is substantially V-shaped in plan view, and includes two plates having the same size that are integrated with each other with a gap therebetween.

More specifically, the arm member 164 includes a base portion 164A having an inverted triangular shape, a first arm 164B that extends obliquely upward from the base portion 164A in front view, and a second arm 164C that extends toward the first movable member 116 in front view of the base portion 164A. In addition, an arc-shaped cut portion 164D to which the support shaft 122 is fixed is formed in the base portion 164A at the lower end (at the vertex) thereof.

Rollers 168A and 168B are rotatably provided at the top ends of the first arm 164B and the second arm 164C, respectively. A spring 170 is attached at one end thereof to the first arm 164B. The spring 170 urges the first arm 164B such that the roller 168A at the top end of the first arm 164B is in contact with the outer peripheral surface of the eccentric cam 160.

The arm member 164 is movable around the support shaft 122 in the +R direction and the −R direction. Accordingly, the first arm 164B and the second arm 164C are movable in the +R direction and the −R direction.

The link member 166 is attached to the roller 168B at the top end of the second arm 164C.

The link member 166 includes a first rod 172, a second rod 174, and a connecting portion 176. One end of the first rod 172 is attached to the roller 168B, and the other end of the first rod 172 is rotatably attached to one end of the second rod 174. The connecting portion 176 connects the other end of the second rod 174 to an end portion of the rotational shaft 156 in the radial direction of the rotational shaft 156.

In this structure, when the rotational force is transmitted from the shaft member 133 to the eccentric cam 160 such that the eccentric cam 160 is rotated in the +R direction, the roller 168A is pushed by the eccentric cam 160 and the arm member 164 is rotated in the +R direction. As a result, the roller 168B pushes the first rod 172. When the first rod 172 is pushed, the pushing force is transmitted through the second rod 174 and the connecting portion 176 to the rotational shaft 156 as a moment. Accordingly, the rotational shaft 156 is rotated in the −R direction and the valve 154 is moved to the open position (see FIG. 5).

When the eccentric cam 160 that receives the rotational force from the shaft member 133 is rotated in the −R direction, the arm member 164 is rotated in the −R direction by the urging force applied by the spring 170. As a result, the first rod 172 is pulled by the roller 168B. When the first rod 172 is pulled, the pulling force is transmitted through the second rod 174 and the connecting portion 176 to the rotational shaft 156. Accordingly, the rotational shaft 156 is rotated in the +R direction and the valve 154 is moved to the closed position (see FIG. 6).

When the shaft member 133 rotates, not only the eccentric cam 160 but also the above-described eccentric cams 132A and 132B rotate. The external shapes of the eccentric cam 160 and the eccentric cams 132A and 132B are determined such that, when the shaft member 133 is rotated in the +R direction, the valve 154 is moved from the closed position to the open position before the cleaning blade 106 and the sealing member 108 are separated from the intermediate transfer belt 68.

In addition, the external shapes of the eccentric cam 160 and the eccentric cams 132A and 132B are determined such that, when the shaft member 133 is rotated in the −R direction, the valve 154 is moved from the open position to the closed position after the state of the cleaning blade 106 and the sealing member 108 is changed from the retracted state to the contact state.

The operation of the cleaning device 100 will now be described.

Referring to FIGS. 1 and 2, when the eccentric cams 132A and 132B are not rotated and the arm members 134 and 138 are not pushed by the eccentric cams 132A and 132B, respectively, an end of the cleaning blade 106 and an end of the sealing member 108 are in contact with the outer peripheral surface of the intermediate transfer belt 68 (contact state), as illustrated in FIG. 7A.

Figure 6:
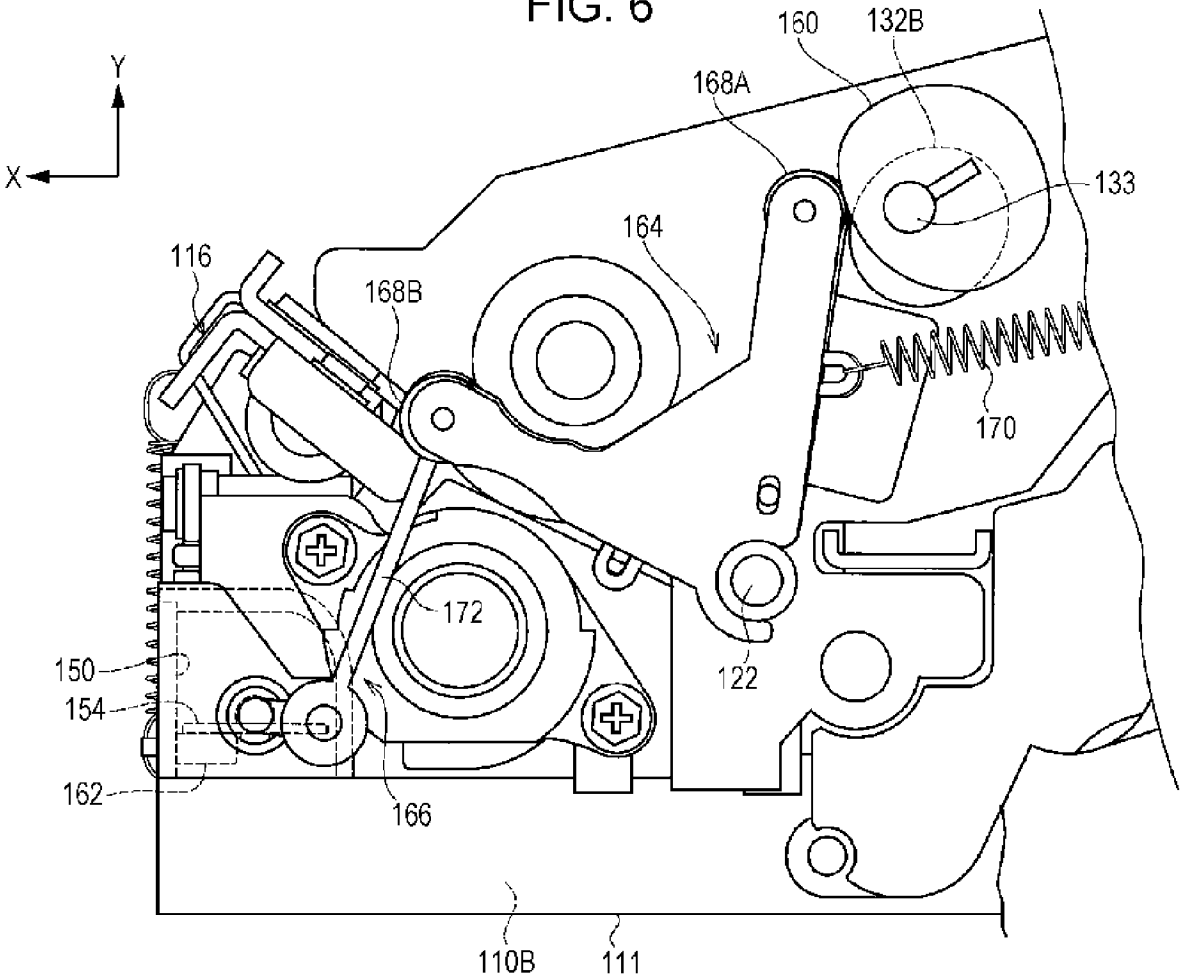
FIG. 6 is another side view illustrating the retracting mechanism included in the cleaning device according to the exemplary embodiment of the present invention.

In the contact state, the valve 154 is closed, as illustrated in FIG. 6. Accordingly, the suction path 110 is closed (narrowed).

As illustrated in FIG. 7A, after the second transfer process in which the toner images on the intermediate transfer belt 68 are transferred onto the sheet of recording paper P (not shown), the residual toner T that has not been transferred remains on the outer peripheral surface of the intermediate transfer belt 68. The residual toner T is transported to the cleaning device 100 by the rotation of the intermediate transfer belt 68 in the direction shown by arrow −R, and is collected into the housing 102 by the cleaning blade 106. At this time, the sealing member 108 is in contact with the outer peripheral surface of the intermediate transfer belt 68 so as to seal the gap between the housing 102 and the sealing member 108. Accordingly, the toner T collected in the housing 102 is prevented form leaking to the outside of the housing 102.

In addition, the valve 154 is in the closed state, so that the opening 150 is closed and the suction path 110 is narrowed (see FIG. 6). As a result, the suction force generated by the suction fan 128 is not applied to the suction path 110A, and dust including the toner is not collected at the filter 112.

Referring to FIGS. 1 and 2, when the toner images of the respective colors are transferred onto the intermediate transfer belt 68 in a superimposed manner (first transfer process), the shaft member 133 is rotated in the +R direction in response to an instruction from the controller 20 (see FIG. 11).

Referring to FIG. 1, when the shaft member 133 is rotated in the +R direction, the eccentric cam 160 is also rotated in the +R direction. When the eccentric cam 160 is rotated in the +R direction, the roller 168A is pushed by the eccentric cam 160 and the arm member 164 is rotated in the +R direction. As a result, the roller 168B pushes the first rod 172 of the link member 166.

When the first rod 172 is pushed, the pushing force is transmitted through the second rod 174 and the connecting portion 176 to the rotational shaft 156 as a rotational force. Accordingly, the rotational shaft 156 is rotated in the −R direction and the valve 154 is moved to the open position (see FIG. 5). Accordingly, the valve 154 is moved to the open position, so that the suction force generated by the suction fan 128 is applied to the inner space of the housing 102 including the suction path 110A.

In addition, referring to FIGS. 1 and 2, when the shaft member 133 is rotated in the +R direction, the eccentric cams 132A and 132B are also rotated in the +R direction. When the eccentric cams 132A and 132B are also rotated in the +R direction, the rollers 136A come into contact with the eccentric cams 132A and 132B.

When the rollers 136A come into contact with the eccentric cams 132A and 132B and the arm members 134 and 138 are moved in the +R direction, the rollers 136B push the contact portions 116B and 116C of the first movable member 116 and move the first movable member 116 in the −R direction (see FIG. 4B).

As shown in FIG. 4B, when the first movable member 116 is moved in the −R direction, the state in which the cleaning blade 106 and the sealing member 108 are separated from the intermediate transfer belt 68 (retracted state) is established.

The eccentric cam 160 and the eccentric cams 132A and 132B have different external shapes, and the external shapes thereof are determined as described above. Therefore, the state of the cleaning blade 106 and the sealing member 108 is changed from the contact state to the retracted state after the valve 154 is moved from the closed position to the open position.

When the cleaning blade 106 and the sealing member 108 are in the retracted state, there is a risk that the toner in the housing 102 will flow out of the housing 102 through the gaps between the intermediate transfer belt 68 and the cleaning blade 106 and between the intermediate transfer belt 68 and the sealing member 108. However, since the valve 154 is moved to the open position, the suction force generated by the suction fan 128 is applied to the inner space of the housing 102. Therefore, the toner in the housing 102 is prevented from flowing out of the housing 102 and is captured by the filter 112. Alternatively, the toner falls onto the bottom wall 102A in the space between the partition wall 117 and the filter 112.

Then, after the toner images that have been transferred onto the intermediate transfer belt 68 in a superimposed manner (first transfer process) are transferred onto the sheet of recording paper P, the shaft member 133 is rotated in the −R direction in FIGS. 1 and 2 in response to an instruction from the controller 20 (see FIG. 11).

When the shaft member 133 is rotated in the −R direction, the eccentric cams 132A and 132B are also rotated in the −R direction. When the eccentric cams 132A and 132B are rotated in the −R direction, the rollers 136A become separated from the eccentric cams 132A and 132B. Accordingly, the first movable member 116 is moved in the +R direction by the urging force applied by the spring 139 (see FIG. 3B).

As shown in FIG. 3B, when the first movable member 116 is moved in the +R direction, the state in which the cleaning blade 106 and the sealing member 108 are in contact with the intermediate transfer belt 68 (contact state) is established.

In addition, referring to FIG. 1, when the shaft member 133 is rotated in the −R direction, the eccentric cam 160 is also rotated in the −R direction. When the eccentric cam 160 is rotated in the −R direction, the arm member 164 is rotated in the −R direction by the urging force applied by the spring 170. When the arm member 164 is rotated in the −R direction, the first rod 172 is pulled by the roller 168B. When the first rod 172 is pulled, the pulling force is transmitted through the second rod 174 and the connecting portion 176 to the rotational shaft 156. Accordingly, the rotational shaft 156 is rotated in the +R direction and the valve 154 is moved to the closed position (see FIG. 6).

The eccentric cam 160 and the eccentric cams 132A and 132B have different external shapes, and the external shapes thereof are determined as described above. Therefore, the valve 154 is moved from the open position to the closed position after the state of the cleaning blade 106 and the sealing member 108 is changed to the contact state.

When the cleaning blade 106 and the sealing member 108 are in the contact state, the toner in the housing 102 does not flow out of the housing 102 through the gaps between the intermediate transfer belt 68 and the cleaning blade 106 and between the intermediate transfer belt 68 and the sealing member 108. After the state in which the toner in the housing 102 is prevented from flowing out of the housing 102 is established, the valve 154 is moved to the closed position (see FIG. 6). Accordingly, the suction force of the suction fan 128 applied to the inner space of the housing 102 is reduced or eliminated.

When the suction force of the suction fan 128 applied to the inner space of the housing 102 is reduced or eliminated, the filter 112 does not capture the toner in the housing 102. As a result, the life of the filter 112 is increased.

As described above, the valve 154 is moved to the open position before the cleaning blade 106 and the sealing member 108 are set to the retracted state, and is moved to the closes position after the cleaning blade 106 and the sealing member 108 are set to the contact state. Thus, the suction force generated by the suction fan 128 is applied to the inner space of the housing 102 and the toner is captured by the filter 112 when there is a risk that the toner in the housing 102 will flow out of the housing 102.

Accordingly, the toner in the housing 102 may be prevented from flowing out of the housing 102, and clogging the filter 112 with the toner may be suppressed at the same time.

In addition, the cleaning blade 106, the sealing member 108, and the valve 154 may be moved without using dedicated drive sources simply by rotating the shaft member 133 with a single power source.

Since clogging of the filter 112 is suppressed, sufficient suction force may be applied to the inner space of the housing 102 when the cleaning blade 106 and the sealing member 108 are in the retracted state. Accordingly, the toner may be reliably prevented from flowing out of the housing 102, and the quality of the image formed by the image forming apparatus 10 may be increased.

Although an exemplary embodiment of the present invention is described in detail above, the present invention is not limited to the above-described exemplary embodiment. It obvious to persons skilled in the art that the other various exemplary embodiments are possible within the scope of the present invention. For example, in the above-described exemplary embodiment, the eccentric cams are formed in different shapes so that the valve 154 is moved at a time different from the time at which the cleaning blade 106 and the sealing member 108 are moved. However, the valve 154 may be moved at a time different from the time at which the cleaning blade 106 and the sealing member 108 are moved by suitably setting the shapes (angles, lengths, etc.) of the arm members or the shapes of the first movable member 116 and the link member 166.

In addition, in the exemplary embodiment, the suction path unit is narrowed by blocking the opening 150 with the valve 154. However, the suction path unit be narrowed without blocking the opening with the valve.

In addition, in the exemplary embodiment, the intermediate transfer belt 68 is described as an example of a developer carrying member. However, the developer carrying member is not limited to this, and may instead be the image carrier, the second transfer roller, the transport belt, etc., to which the developer adheres.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer collecting device comprising:

a housing provided with an opening opposed to a developer carrying member to which developer adheres while the developer carrying member rotates;

a collecting member provided along an edge of the opening at a downstream end of the opening in a transporting direction of the developer carrying member, the collecting member removing the developer from an outer peripheral surface of the developer carrying member and collecting the developer into the housing when the collecting member is in contact with the developing carrying member;

a suction unit that sucks air from the opening and makes air flow;

a flow rate regulating member provided in a suction path between the suction unit and the housing, the flow rate regulating member changing a flow rate of the air;

a first moving member that moves the collecting member between a position at which the collecting member is in contact with the developing carrying member and a position at which the collecting member is separate from the developer carrying member;

a second moving member that moves the movable portion that is included in the flow rate regulating member between a position for shutting the suction path and a position for opening the suction path; and an operation device that moves the collecting member and operates the flow rate regulating member such that the flow rate regulating member raises the flow rate before the separation of the collecting member from the developer carrying member, wherein the flow rate regulating member has a movable portion that shuts or opens the suction path, the operation device includes:

a rotational shaft that rotates;

a first cam that is attached to the rotational shaft and that directly or indirectly moves the first moving member; and a second cam that is attached to the rotational shaft and that directly or indirectly moves the second moving member, and the first cam and the second cam move the first moving member and the second moving member, respectively, at different times so that the suction path shut by the movable portion is opened before the separation of the collecting member from the developer carrying member.

2. The developer collecting device according to claim 1, wherein the first cam and the second cam are determined so that the first cam and the second cam move the movable portion from the position for opening the suction path to the position for shutting the suction path after the cleaning blade contacts with the developer carrying member.

3. An image forming apparatus, comprising:

the developer collecting device according to claim 1; and a developer carrying member from which developer is collected by the developer collecting device, wherein the developer is collected after the developer carrying member transfers an image onto a recording medium.

* * * * *